United States Patent [19]

Ganz, Jr. et al.

[11] 4,236,646

[45] Dec. 2, 1980

[54] CLOSURE FOR PHARMACEUTICAL CONTAINERS

[75] Inventors: Rudolf V. Ganz, Jr., Ebmatingen, Switzerland; David A. Winchell, Twin Lakes, Wis.

[73] Assignee: Baxter Travenol Laboratories, Inc., Deerfield, Ill.

[21] Appl. No.: 86,545

[22] Filed: Oct. 19, 1979

Related U.S. Application Data

[63] Continuation of Ser. No. 956,832, Nov. 2, 1978, abandoned.

[51] Int. Cl.[3] ..... B65D 41/32

[52] U.S. Cl. ..... 215/232; 215/253

[58] Field of Search ..... 215/232, 251, 253, 250

[56] References Cited

U.S. PATENT DOCUMENTS

| | | | |
|---|---|---|---|
| 3,923,183 | 12/1975 | Choksi et al. | 215/251 |
| 3,923,185 | 12/1975 | Choksi | 215/232 |
| 3,974,008 | 8/1976 | Choksi | 215/232 X |
| 4,111,325 | 9/1978 | Bellamy et al. | 215/253 X |
| 4,181,232 | 1/1980 | Bellamy et al. | 215/232 |

*Primary Examiner*—George T. Hall

*Attorney, Agent, or Firm*—Paul C. Flattery; John P. Kirby, Jr.; George H. Gerstman

[57] ABSTRACT

A hermetically sealed container is provided in which a cup-shaped overcap overlies an externally threaded dispensing outlet and is hermetically bonded to the bottle neck. An outer jacket ring is provided to jack the overcap off of the bottle neck when the jacking ring is rotated downwardly. The overcap carries a wiper seal which engages the dispensing outlet to prevent liquid flow out of the dispensing outlet until the overcap is removed. The container closure is tamper-proof in that the overcap cannot be threadedly engaged with the externally threaded dispensing outlet once the overcap has been jacked off the bottle neck.

10 Claims, 2 Drawing Figures

CLOSURE FOR PHARMACEUTICAL CONTAINERS

BACKGROUND OF THE INVENTION

Containers for storing and dispensing sterile liquids are known which have an inner or primary cap and an outer or overcap. Such containers are in common use for various medical and hospital procedures, such as the administration of irrigating solutions. Such sterile medical liquid containers have a common purpose of maintaining the sterility of their liquid contents during storage, shipping and dispensing. It is necessary that the closure system by easy for the nurse or physician to open, advantageously by the customary, continuous, counter-clockwise rotation of the closure on the container.

The containers are commonly made of disposable, thermoplastic material and for maximum safety in hospital procedures, the containers should be discarded after opening and use. A container that has a non-resealable closure, is formed of disposable, thermoplastic material and will typically be discarded after opening and use, is disclosed in Bellamy and Winchell U.S. application Ser. No. 871,320, filed Jan. 23, 1978, now U.S. Pat. No. 4,111,235, issued on Sept. 5, 1978. We have discovered, however, that it is often desirable in laboratory use to utilize thermoplastic bottles having resealable characteristics. An example of a thermoplastic bottle that can be resealed is disclosed in Fowles and Winchell U.S. Pat. No. 4,093,093, in which the primary or inner cap threadedly engages with the external threads of the container neck.

It is, therefore, an object of the present invention to provide a hermetically sealed container which has a tamper-proof seal and is non-resealable by using the inner or primary cap but can be converted to a resealable container if desired.

Another object of the present invention is to provide a hermetically sealed container which is simple in construction and efficient to manufacture.

A further object of the present invention is to provide a hermetically sealed container having an externally threaded dispensing outlet with an inner or primary cap that cannot be threadedly engaged with the dispensing outlet, whereby the basic unit is non-resealable.

A still further object of the present invention is to provide a hermetically sealed container in which after the inner or primary cap is removed, such inner or primary cap cannot be resealed to the container but a separate, standard screw cap may be used to close the container if desired.

Another object of the present invention is to provide a hermetically sealed container which utilizes a jacking ring to jack a non-resealable primary cap off the dispensing outlet.

Other objects and advantages of the invention will become apparent as the description proceeds.

BRIEF DESCRIPTION OF THE INVENTION

In accordance with the invention, a hermetically sealed container is provided for storing and dispensing sterile liquids. The container includes a bottle with a neck defining an externally threaded dispensing outlet. The bottle has a transverse abutment means on the neck surrounding the outlet.

The improvement comprises a cup-shaped overcap having a cylindrical side wall and a top wall over the dispensing outlet, with the overcap being hermetically bonded to the bottle neck. Wiper seal means are carried by the overcap and engage the dispensing outlet to prevent liquid flow out of the dispensing outlet. An outer ring is threadedly interfitted over the overcap and is adapted for downward rotation to abut the abutment means and jack the overcap off the bottle neck.

In the illustrative embodiment, the cylindrical side wall of the overcap is spaced from the externally threaded dispensing outlet and has a non-threaded internal wall. In this manner, the side wall of the overcap and the externally threaded dispensing outlet cannot be threadedly engaged.

In the illustrative embodiment, the wiper seal means comprises a circular ring which extends downwardly from the underside of the top wall. The ring has an external surface in seal-type engagement with the internal wall of the dispensing outlet.

In the illustrative embodiment, the hermetic bond comprises a heat-fused seal between the overcap and the bottle neck forming a frangible section.

A more detailed explanation of the invention is provided in the following description and claims, and is illustrated in the accompanying drawings.

DETAILED DESCRIPTION OF THE ILLUSTRATIVE EMBODIMENT

Figure 1:
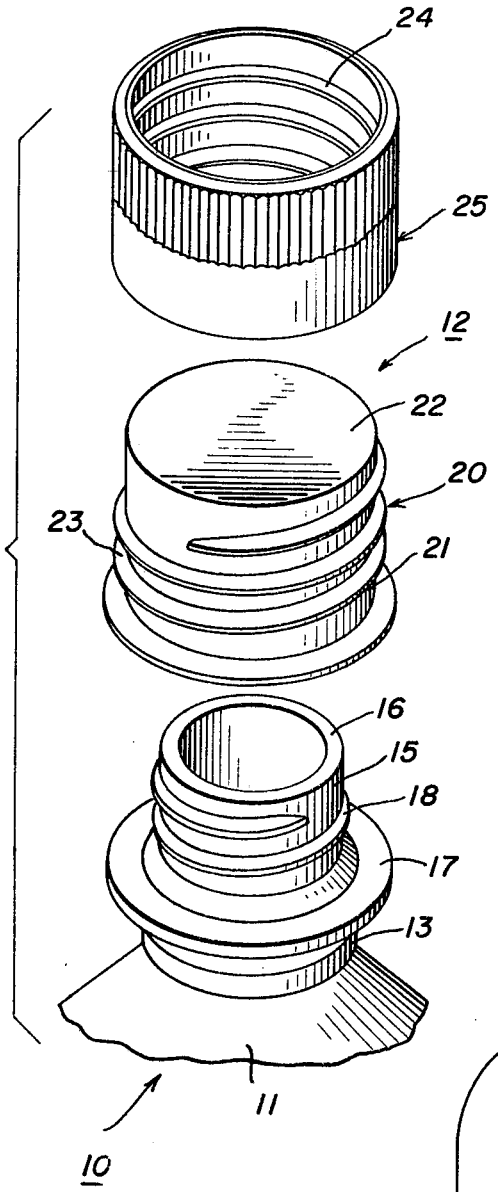
FIG. 1 is an exploded view a fragmentary portion of a hermetically sealed container constructed in accordance with the principles of the present invention, showing the closure thereof.
Figure 2:
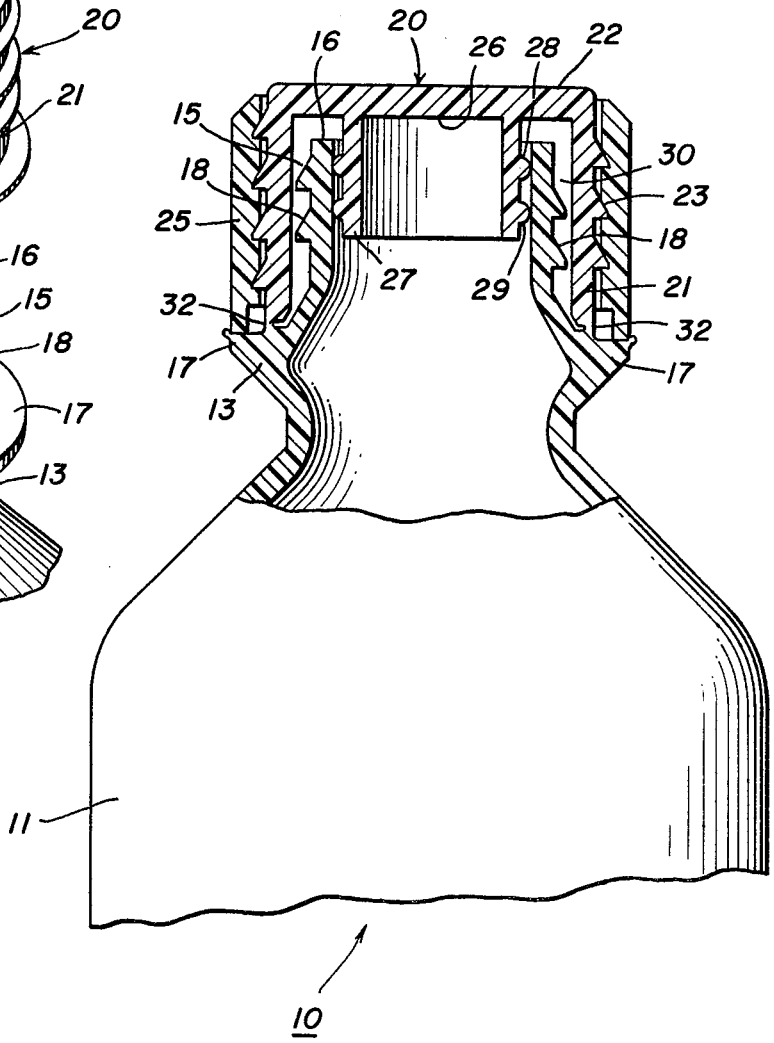
FIG. 2 is a fragmentary view of the top portion of a hermetically sealed container constructed in accordance with the principles of the present invention, taken primarily in cross section for clarity, showing the closure in its fully closed position.

Referring to the drawings, there is illustrated a thermoplastic container 10 including a thermoplastic bottle 11 and a thermoplastic closure system 12, contained on a bottle neck 13 of the bottle 11. Container 10 contains sterile medical liquids, such as normal saline, sterile water and the like, commonly supplied to hospitals. In the illustrative embodiment, the container has a dispensing outlet 15 extending through and defined by bottle neck 13, with the bottle neck terminating in a pouring lid 16. A transverse abutment means 17 is provided on the neck 13 surrounding dispensing outlet 15.

The dispensing outlet 15 includes external threads 18 which are dimensioned for threading engagement with the internal threads of a standard screw cap (not shown). However, the container of the illustrative embodiment utilizes a non-resealable closure unit whereby once the primary closure is removed, the primary closure cannot be engaged securely with the dispensing outlet.

The primary closure comprises a cup-shaped overcap 20 having a cylindrical side wall 21 and a top wall 22. Cylindrical side wall 21 carries external threads 23 which threadedly engage the internal threads 24 of an outer ring 25.

The underside 26 of top wall 22 carries wiper means 27. The wiper means includes a downwardly extending ring carrying a pair of annular beads 28, 29, which serve to wipe the internal wall of dispensing outlet 15, thereby preventing liquid from flowing from the bottle to the outside of the dispensing outlet. Thus, the volume 30 between the overcap 20 and the dispensing outlet 15 will be free from liquid if the bottle happens to be tilted or inverted, unless the overcap 20 has been removed.

The external diameter of the beads 28, 29 is at least as great as the internal diameter of dispensing outlet 15. However, the remaining external diameter of the circular ring 27 is smaller than the internal diameter of dispensing outlet 15.

It is preferred that the bottle 11, neck 13, dispensing outlet 15 and abutment means 17 be molded in a one-piece construction, and that the cup-shaped overcap 20 be molded in a separate, one-piece construction. The overcap is hermetically bonded to the bottle neck 13, preferably by heat-fusing the lower portion of the overcap 20 to the transverse abutment means 17. An example of a type of heat sealing which may be utilized is disclosed in Bellamy and Winchell U.S. application Ser. No. 871,320, filed Jan. 23, 1978, now U.S. Pat. No. 4,111,235.

In the illustrative embodiment, the heat-fused seal between the overcap 20 and the transverse abutment means 17 forms a frangible section 32. Outer ring 25 is placed in threaded engagement with overcap 20 and, when the outer ring is rotated downwardly, the bottom of the outer ring 25 will abut transverse abutment means 17 and the frangible section 32 will be severed and the overcap 20 will be jacked off of the bottle neck.

Outer ring 25 preferably has a left-handed thread so that when it is turned in the counter-clockwise direction it will rotate downwardly. In this manner, operators who are used to opening containers by turning the closure in a counter-clockwise direction, will be able to jack off the overcap 20 by turning the outer ring 25 in a counter-clockwise direction.

If desired, means may be provided for preventing the outer ring 25 from being removed from the overcap 20 when the outer ring is turned in the clockwise direction. To this end, an anti-backoff mechanism may be provided such as disclosed in Fowles and Winchell U.S. Pat. No. 4,093,093 or Fowles and Winchell U.S. Pat. No. 4,091,949.

It can be seen that a container has been provided which is simple to open, is simple in construction and is easy to manufacture. In one embodiment, a non-resealable unit dose container is provided for maximum safety in hospitals, by not enabling the primary closure to be securely engaged with the dispensing outlet once the primary closure has been removed. On the other hand, the dispensing outlet carries threads which are adaptable for engaging the internal threads of a standard screw cap so that, for laboratory use, the container may be resealed.

Although an illustrative embodiment of the invention has been shown and described, it is to be understood that various modifications and substitutions may be made by those skilled in the art without departing from the novel spirit and scope of the present invention.

That which is claimed is:

1. An improvement in a hermetically sealed container for storing and dispensing sterile liquids, said container including a bottle with a neck defining an externally threaded dispensing outlet, said bottle having a transverse abutment means on the neck surrounding the outlet, said improvment comprising, in combination:

a cup-shaped overcap having a cylindrical side wall and a top wall over the dispensing outlet, with said overcap being hermetically bonded to the bottle neck;

wiper seal means carried by said overcap and engaging the dispensing outlet to prevent liquid flow out of the dispensing outlet until the overcap is removed; and an outer ring threadedly interfitting over said overcap and adapted for downward rotation to abut said abutment means and jack said overcap off said bottle neck.

2. An improvement as described in claim 1, said wiper seal means comprising a circular ring which extends downwardly from the underside of said top wall, said ring having an external surface in seal-type engagement with the internal wall of the dispensing outlet.

3. An improvement as described in claim 2, said circular ring carrying bead means on its external surface to provide said seal-type engagement, said circular ring having, except for said bead means, an external diameter that is smaller than the internal diameter of the dispensing outlet and said bead means having an external diameter that is at least as large as the internal diameter of the dispensing outlet.

4. An improvement as described in claim 1, said cylindrical side wall being spaced from the externally threaded dispensing outlet and having a non-threaded internal wall whereby said side wall and said externally threaded dispensing outlet cannot be threadedly engaged.

5. An improvement as described in claim 1, said hermetic bond comprising a heat-fused seal between said overcap and said bottle neck forming a frangible section.

6. An improvement in a hermetically sealed container for storing and dispensing sterile liquids, said container including a bottle with a neck defining an externally threaded dispensing outlet, said bottle having a transverse abutment means on the neck surrounding the outlet, said improvement comprising, in combination:

a cup-shaped overcap having a cylindrical side wall and a top wall over the dispensing outlet, with said overcap being hermetically bonded to the bottle neck;

said hermetic bond comprising a heat-fused seal between said overcap and said bottle neck forming a frangible section;

said cylindrical side wall being spaced from the externally threaded dispensing outlet and having a non-threaded internal wall whereby said side wall and said externally-threaded dispensing outlet cannot be threadedly engaged;

wiper seal means carried by said overcap and engaging the dispensing outlet to prevent liquid flow out of the dispensing outlet until the overcap is removed; and an outer ring threadedly interfitting over said overcap and adapted for downward rotation to abut said abutment means and jack said overcap off said bottle neck.

7. An improvement as described in claim 6, said wiper seal means comprising a circular ring which extends downwardly from the underside of said top wall, said ring having an external surface in seal-type engagement with the internal wall of the dispensing outlet.

8. An improvement as described in claim 7, said circular ring carrying bead means on its external surface to provide said seal-type engagement, said circular ring having, except for said bead means, an external diameter that is smaller than the internal diameter of the dispensing outlet and said bead means having an external diameter that is at least as large as the diameter of the dispensing outlet.

9. An improvement as described in claim 1 wherein the lower surface of said top wall is spaced from the dispensing outlet.

10. An improvement as described in claim 6 wherein the lower surface of said top wall is spaced from the dispensing outlet.

* * * * *